US010012467B2

(12) United States Patent
Meadows

(10) Patent No.: US 10,012,467 B2
(45) Date of Patent: Jul. 3, 2018

(54) ARCHER RELEASE

(71) Applicant: Jesse W. Meadows, Susanville, CA (US)

(72) Inventor: Jesse W. Meadows, Susanville, CA (US)

( * ) Notice: Subject to any disclaimer, the term of this patent is extended or adjusted under 35 U.S.C. 154(b) by 0 days.

(21) Appl. No.: 15/330,953

(22) Filed: Jul. 1, 2015

(65) Prior Publication Data

US 2017/0276450 A1 Sep. 28, 2017

Related U.S. Application Data

(60) Provisional application No. 62/019,618, filed on Jul. 1, 2014.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 4,282,851 A * 8/1981 Lyons ..... F41B 5/1469 124/35.2
4,316,443 A * 2/1982 Giacomo ..... F41B 5/1469 124/35.2
5,031,600 A * 7/1991 Moore ..... F41B 5/1469 124/35.2
6,058,920 A * 5/2000 Tentler ..... F41B 5/1469 124/35.2
6,481,430 B1 * 11/2002 Lightcap, Jr. ..... F41B 5/1469 124/35.2
6,763,819 B2 * 7/2004 Eckert ..... F41B 5/1469 124/35.2

* cited by examiner

*Primary Examiner* — John Ricci
(74) *Attorney, Agent, or Firm* — Ian F. Burns; ATIP law

(57) ABSTRACT

An archer release aid includes an engagement mechanism that is operated by a thumb or finger of an archer to engage and retain a bow string or attachment thereto such as a D-loop. The engagement mechanism may be biased so that when the archer releases pressure on the actuator, the engagement mechanism disengages the bow string. A locking mechanism may be operated by another finger of the archer, such as the little finger, to lock the engagement mechanism in the engaged position. The release aid allows muscle relaxation, rather than muscle tension, to be the final triggering mechanism.

19 Claims, 3 Drawing Sheets

ARCHER RELEASE

CROSS REFERENCE TO RELATED APPLICATIONS

This application claims priority to U.S. provisional patent application Ser. No. 62/019,618, filed 1 Jul. 2014, the contents of which are herein incorporated by reference.

FIELD OF THE INVENTION

The present invention relates to release mechanisms typically used as firing aids in archery.

BACKGROUND

Archery releases are devices that assist in firing of an archery bow. There are currently three different types of releases. The first is a typical thumb trigger release whereby the archer locks a hook onto a "D" loop attached to the string of the archery bow, draws back the string using the release, and uses muscle tension to pull the thumb back which pulls the trigger back and releases the string. The second release is called a "Back Tension Release". To use this release the archer positions his hook to where it catches a shelf on the release and he attaches the hook to the "D" loop and draws back. Once the archer is ready he slowly tweaks his wrist until the release lets loose and fires the arrow. The third type of release is another "Back Tension Release" whereby the archer either locks or hooks the release to the "D" loop and draws back and continues to increase back-pressure with the arm until the release fires.

One problem with each of these three types of trigger release is that they each require muscle tension in order to fire the arrow which can result in trigger jerk (the act of jerking the trigger, and consequently the bow, due to anticipation or nervousness.

What is required is an improved archer release device.

SUMMARY OF ONE EMBODIMENT OF THE INVENTION

Advantages of One or More Embodiments of the Present Invention

The various embodiments of the present invention may, but do not necessarily, achieve one or more of the following advantages:

provide an alternative archer release aid;

the ability to release a bow by muscle relaxation rather than muscle tension;

the ability to set down a loaded bow;

provide an ergonomic grip for operating a bow.

These and other advantages may be realized by reference to the remaining portions of the specification, claims, and abstract.

Brief Description of One Embodiment of the Present Invention

In one aspect, there is provided an archer release aid including an engagement mechanism and a lock mechanism. The engagement mechanism may selectively engage a bow string or attachment thereto via a first actuator. The lock mechanism may lock the engagement mechanism in a configuration that engages the bow string or attachment.

In one aspect, there is provided an archer release aid including engagement means and locking means. The engagement means may engage a bow string or attachment thereto. The locking means may lock the engagement means in engagement with the bow string or attachment. An actuator may actuate the locking means. An engagement means actuator may be selectively actuated to release the engagement means, thereby firing the bow.

In one aspect, there is provided a method of operating an archery bow using a release aid. Initially, an engagement mechanism is actuated to engage the bow string or an attachment thereto such as a D-loop. A locking mechanism is then actuated to lock the engagement mechanism after which the bow can be drawn. The locking mechanism can then be released to release the engagement mechanism. The bow may be fired by the archer releasing an actuator of the engagement mechanism.

In one aspect, there is provided an archer release aid comprising an engagement mechanism. A button or similar actuator may be pressed by the archer to cause the engagement mechanism to engage and retain a bow string or attachment thereto. The engagement mechanism may be biased so that when the archer releases pressure on the actuator, the engagement mechanism disengages the bow string or attachment.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The present invention provides an archer release aid that enables the archer to release a drawn bow using muscle relaxation, rather than muscle tension. The release aid includes an engagement mechanism for selectively engaging the bow. The release aid is intended to operate with a D-loop or similar attachment that connects to a bow string and is typically used by many archers. However, for the sake of clarity throughout the specification, the invention will be described with reference to engagement of a bow string, which is to be taken herein and in the claims that follow to include engagement of a D-loop, direct engagement of the bow string, or engagement of any other device on the bow string that may be employed by an archer that is separate from the release aid itself. The release aid also includes a locking mechanism for locking the engagement mechanism. The release aid provides an ergonomic grip with the engagement mechanism and locking mechanism each being operated by one or more fingers or thumb of the archer. For clarity in the specification and claims that follow, it is to be understood that unless explicitly indicated, any reference to the finger or fingers of the archer may include the thumb of the archer.

Figure 1:
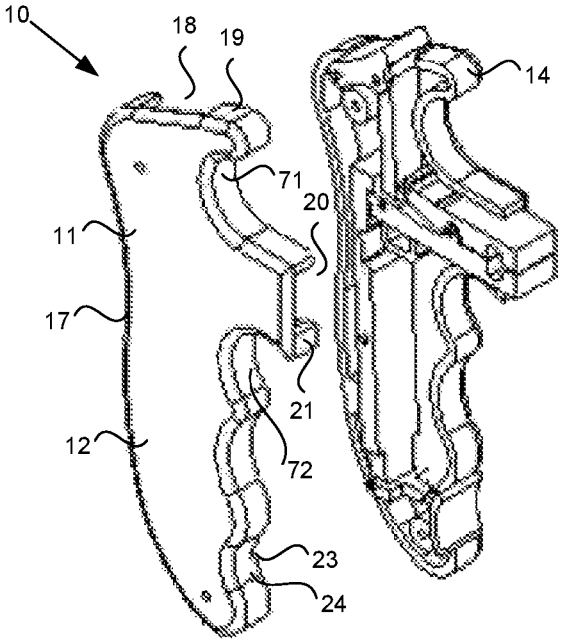
FIG. 1 substantially shows an exploded view of an archer release device.

FIG. 1 shows a partial exploded view of an archer release aid 10 in accordance with an embodiment of the present invention. The archer release aid 10 includes two part housing 11 having a front part 12 and rear part 14. The housing parts 12, 14 may be attached by press fit, adhesives, screws or other suitable attachments. The housing 11 is shaped to be held within the hand of the operator and includes ergonomic features including contoured finger portions 16 and palm section 17.

The housing 11 includes a first aperture 18 in the upper surface 19 and a second aperture 20 in the front surface 21 toward an upper end of the surface, between the finger contours for the index and middle finger 71, 72 of the operator. The housing 11 includes a third aperture 23 located in the finger contour for the little finger (pinky finger) 24 of the operator.

Within the housing parts 12, 14 are the internal working components of the archer release 10. The working components of the archer release 10 will be described with reference to FIG. 2.

Figure 2:
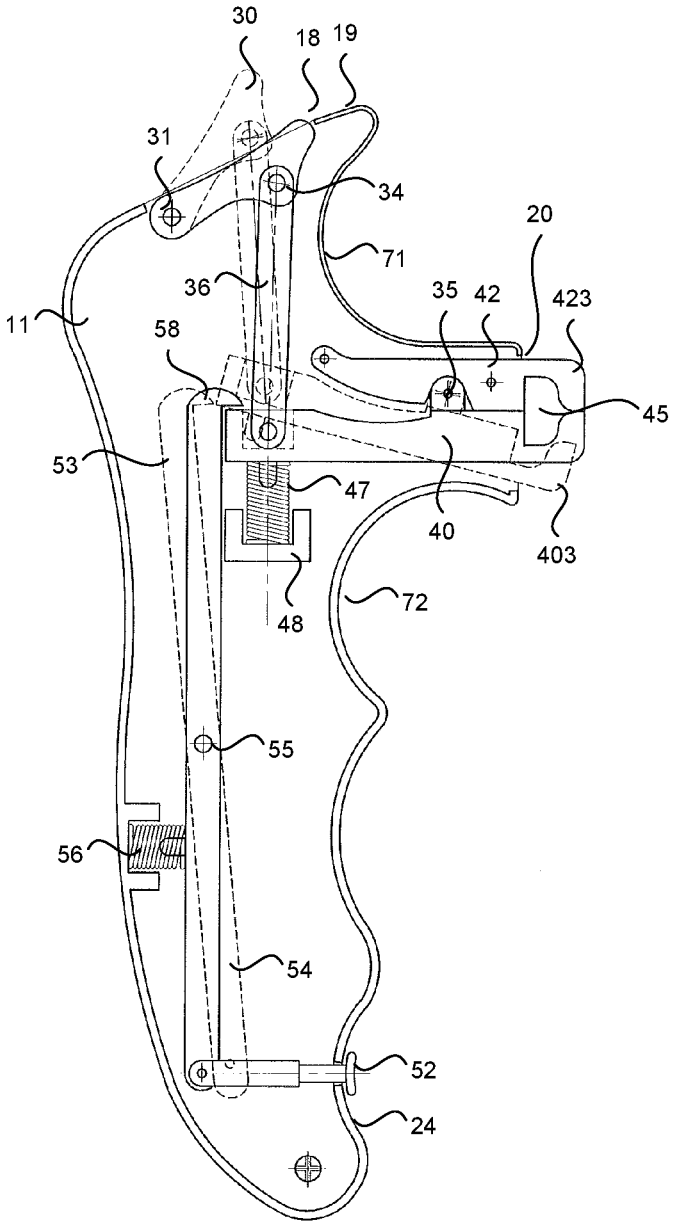
FIG. 2 substantially shows the internal components of the archer release device.

FIG. 2 shows the components in a released or relaxed position in ghosted outline and in a locked position in solid outline. The release aid 10 includes an engagement mechanism that includes a first actuator in the form of a thumb button 30 that is exposed through the first aperture 18. The thumb button 30 pivots about a first pivot 31 that is fixed to the housing 11. In the relaxed position, the thumb button extends out of the aperture 18 above the surface 19. The engagement mechanism includes a first attachment arm 36. The thumb button 30 has a second pivot 34 at the opposite end that connects to the first attachment arm 36. The engagement mechanism includes a first part in the form of an upper hook arm 42 and a second part in the form of a lower hook arm 40. The attachment arm 36 extends from the button 30 to a lower hook arm 40. The lower hook arm pivots about a pivot 35 to cooperate with an upper hook arm 42.

Figure 3:
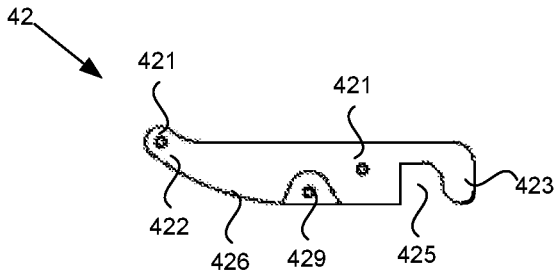
FIG. 3 substantially shows a side view of an upper hook arm.
Figure 4:
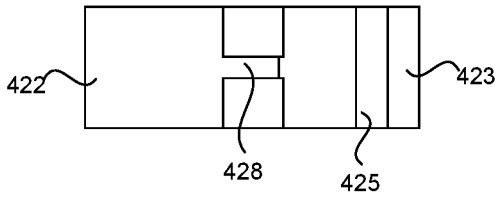
FIG. 4 substantially shows an under view of the upper hook arm.

The upper hook arm is shown in side view in FIG. 3 and under view in FIG. 4. The upper hook arm 42 has a first end 422 and a second end 423. The second end 423 protrudes through the aperture 20 of the housing 11. The upper hook arm is fixed to the housing 11 on one or more attachment points, such as the two attachment points 421 illustrated. A groove 425 across the first hook portion is formed toward the free end 423. The groove provides a first portion of a hook or opening. The underside 426 of the upper hook arm 42 has a concave profile at the first end 422 that terminates in a narrowed section 428. The narrowed section has a central aperture 429.

Figure 5:
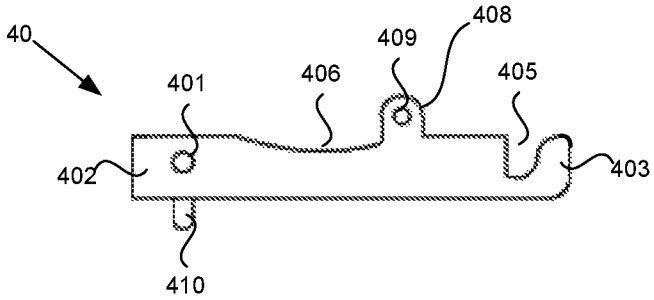
FIG. 5 substantially shows a side view of a lower hook arm.
Figure 6:
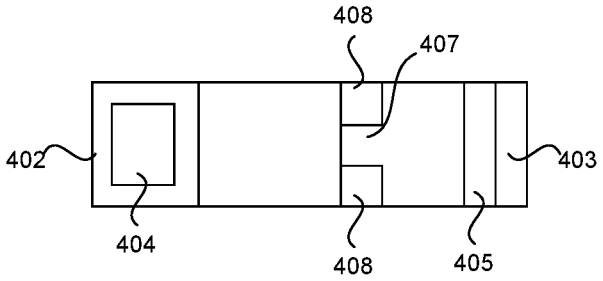
FIG. 6 substantially shows a top view of the lower hook arm.

The lower hook arm 40 is shown in side view in FIG. 5 and top view in FIG. 6. The lower hook arm 40 has a first end 402 and a second end 403. The second end 403 protrudes through the aperture 20 of the housing 11. A groove 405 across the width of the lower hook arm 40 is formed toward the free end 403. The groove 405 provides a second portion of a hook or opening. The upper side 406 of the lower hook arm 40 has a convex profile that matches the concave surface 426 of the upper hook arm 42. Toward the second end of the convex surface 406 are two upwardly extending projections 408. The projections each have an aperture 409 that extends across the width of the projection. The projections 408 are separated by a slot 407 that is sized to receive the narrowed section 428 of the upper hook arm 40.

The upper hook arm 42 and lower hook arm 40 may be joined by inserting the central section 428 of the upper hook arm into the slot 407 of the lower hook arm 40 such that the apertures 409 and 429 are aligned. A pin (not shown) may be inserted through the apertures 409, 429 to secure the upper hook arm and lower hook arm together and provide relative pivotal rotation about the pin.

When the upper and lower hook arms are joined, the grooves 405, 425 are aligned so that together they define an internal opening. As the hook arms 40, 42 pivot relative to each other, they move between an open configuration in which the internal opening is opened through the free ends 403, 423 and a closed configuration in which the free ends 403, 423 contact each other to thereby close the internal opening formed by the two cooperating grooves 405, 425. It should be noted that in the closed configuration, it is not essential that the free ends 403, 423 are in contact. The engagement mechanism provided by the upper and lower hook arms may be considered to be in the closed configuration if any gap between the free ends 403, 423 is sufficiently small to retain the bow string or D-loop connected to the bow string. Both the leading and trailing edges of the upper and lower hook arms at the free ends of 423, 403 may be rounded to prevent damage to the D-loop or bow string.

While the upper and lower parts 40, 42 each contribute half of the internal opening, other configurations will be apparent to the person skilled in the art. For example, one part may be flat and one part may be grooved. The specific configuration may be adapted depending on the intended connection of the release aid 10 to the bow, e.g. directly to the string of the bow, through a D-loop connection, or via other suitable attachments.

At the first end 402 of the lower hook arm, there is an opening 404 that receives the attachment arm 36. An aperture 401 in the sides of the of the lower hook arm that define the opening 404 receives a pin or similar axle that allows pivoting connection between the lower hook arm 40 and the attachment arm 36.

A post 410 or similar projection extends from the underside of the lower hook arm 40 toward the first end 402. The post 410 may be inserted through the center of a coil spring 47 to provide biasing of the engagement mechanism as will be described in more detail below.

Returning to FIG. 2, together, the upper and lower hook arms create an internal opening or hook aperture 45 that is open when the lower hook arm 40 is in the relaxed position and is closed when the lower hook arm 40 is in the locked position, as will be described in more detail below. The lower hook arm 40 is biased toward the relaxed position by a spring 47 that sits in a holder 48 and engages the post 410.

The upper and lower hook arms each include a free end 423, 403 that protrudes from the second aperture 20.

The release 10 includes a second operable button 52 that protrudes through the third aperture 23. The button 52 attaches to a lock mechanism or lock means in the form of a second attachment arm 54 that pivots about a central pivot 55. A spring 56 biases the second attachment arm 54 to the relaxed position shown in ghosted outline. In alternative embodiments, the spring bias 56 may be replaced with alternative bias devices or the user may be required to manually return the second attachment arm to the relaxed position. At an upper end 53 of the second attachment arm is a hook portion 58 that engages the lower hook arm 40. A small lip (not shown) on each piece, 58 and 40, may be provided to enable engagement between the hook portion 58 and the lower hook arm 40. Alternatively or in addition, frictional surfaces may be employed. The functionality of the release aid 10 is as follows. In order to use the release, the archer holds the archer release aid 10 in one hand with their fingers in the finger grips shown. Initially, neither of the thumb button 30 or pinky button 52 are pressed and thus the engagement mechanism is in the open configuration and the lock mechanism is in the free position. The archer first presses the thumb button 30 to close the hook formed by the free ends 423, 403 of the upper and lower hook arms 42, 40 onto the "D" loop attached to the string of the archery bow. While maintaining pressure on the thumb button 30 the archer then presses the lock button 52 with his pinkie finger, thus bringing the hook portion 58 of the upper end 53 of the second attachment arm 54 into engagement with the lower hook arm 40, thereby locking the hook aperture 45 around the D loop. Once the archer draws back, the release is now locked and the archer can relax both thumb and pinkie. At this point, a combination of forward pressure on the hook arms from the bow and upward pressure of the lower hook arm 40 on the hook portion 58 by the spring 47 maintains the locking mechanism in the locked position so that the engagement mechanism is maintained in the closed configuration. The archer can settle onto his target and can even let down safely (release the pressure off the draw string so as not to fire the arrow, but to rest). The reason the lock will not disengage is due to the curvature at the aperture 45, where the D-Loop resides, and because the forward pressure of the loop which forces the rear end of the lower hook arm 40 back toward the thumb keeps the lips on 58 and 40 engaged.

As the archer is at full draw with thumb button 30 locked via the pinkie button 52, he can now place steady and constant pressure on the thumb button 30. This pushes the first attachment arm 36 downward sufficient enough to release engagement pressure between the lower hook arm 40 and the extension 58 of the second attachment arm, thereby causing the second attachment arm 54 to release under the action of the biasing spring 56, in turn freeing the lower hook arm 40 from the hook portion 58. The archer has not fired yet. When ready, he can now relax his thumb slowly off the thumb button 30, thereby causing the biasing spring 47 to return the lower hook arm to the relaxed or free position, in the process opening the hook aperture 45 and releasing the arrow. The clearance has been engineered enough to where the free ends 403, 423 can come together to close the aperture 45, allowing the lips at the hook portion 58 and the base of 40 to clear each other. The clearance between the free ends 403, 423 is smaller than the diameter of the D-Loop so as not to allow the D-Loop to slip through against the archers will).

An advantage of the presently described release mechanism is that the final firing action is caused by muscle relaxation, rather than muscle tension, which can aid if accuracy of operation of the bow.

Terms used to describe orientation, such as front, back, top, under, left, right etc. are to provide reference to the illustrations as depicted and are not intended to limit the invention in any manner.

While the embodiments depict operation of the first and second buttons by the thumb and little finger respectively, modifications to this arrangement are possible as would be apparent to the person skilled in the art.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A release aid for archery, the release aid comprising:

(A) an engagement mechanism that engages a string of a bow, the engagement mechanism selectively moveable between an open configuration and a closed configuration, the engagement mechanism comprising:

(a) a first part;

(b) a second part, wherein the first part and second part move relative to each other between the open configuration and the closed configuration, wherein in the closed configuration the first part and the second part cooperate to retain the string and wherein in the open configuration the first part and the second part are able to release the string;

(c) a first actuator operated by one or more first fingers of a user to actuate at least one of the first part and the second part to move from the open configuration to the closed configuration;

(d) a bias mechanism that biases at least one of the first part and the second part to the open configuration;

(B) a lock mechanism that is selectively moveable between a free position and a lock position, wherein in the lock position the lock mechanism engages and locks the engagement mechanism in the closed configuration;

(C) a second actuator operated by one or more second fingers of the user to actuate the lock mechanism between the free position and the lock position.

2. The release aid of claim 1 wherein the bias mechanism biases the first actuator such that when a user releases pressure on the first actuator and the lock mechanism is in the free position, the engagement mechanism is able to disengage the string, thereby firing the bow.

3. The release aid of claim 1 comprising a housing that houses the engagement mechanism and the lock mechanism wherein the housing comprises one or more contoured finger grip portions.

4. The release aid of claim 3 wherein the first actuator comprises a first button that protrudes from a first aperture in the housing.

5. The release aid of claim 4 wherein the first aperture aligns with a thumb grip portion of the housing.

6. The release aid of claim 3 wherein the first actuator comprises a second button that protrudes from a second aperture in the housing.

7. The release aid of claim 6 wherein the second button aligns with a little finger grip portion of the housing.

8. The release aid of claim 1 wherein the first part and the second part together define an internal opening that is configured to retain the string of the bow in the closed configuration.

9. The release aid of claim 8 wherein the first part defines a first half of the internal opening and the second part defines a second half of the internal opening, the internal opening being substantially closed when the second part is brought against the first part.

10. The release aid of claim 8 wherein the first part and the second part are pivotally connected to each other.

11. The release aid of claim 10 comprising a housing, wherein the first part is fixedly connected to the housing.

12. The release aid of claim 10 wherein the second part connects to the first actuator via a first attachment arm.

13. The release aid of claim 1 wherein the lock mechanism comprises a second attachment arm that engages at least one of the first part or the second part when the engagement mechanism is in the closed configuration.

14. The release aid of claim 13 wherein the second actuator comprises a second button that is operatively connected to the second attachment arm, wherein actuation of the second button causes the second attachment arm to pivot from a free position to a locked position in which the second attachment arm engages at least one of the first part or the second part.

15. The release aid of claim 13 wherein the second attachment arm is biased to the free position.

16. A release aid for archery comprising:

(A) engagement means for engaging a bow string;

(B) locking means for locking the engagement means in engagement with the bow string;

(C) actuator means for actuating the locking means;

(D) housing means comprising grip means wherein the actuator means is located in at least one finger grip of the grip means; and (E) a second actuator disposed in the housing means in a second finger grip of the grip means.

17. The release aid of claim 16 comprising engagement actuator means for selectively actuating the engagement means to engage or release the bow string.

18. The release aid of claim 16 comprising:

(A) first hook means for providing a first hook portion;

(B) second hook means for providing a second hook portion;

(C) wherein the second hook means is pivotal relative to the first hook means.

19. The release aid of claim 18 wherein the first hook means and second hook means cooperate together to form a closed hook that retains the bow string.

* * * * *